US009033172B2

(12) United States Patent
Thati

(10) Patent No.: US 9,033,172 B2
(45) Date of Patent: May 19, 2015

(54) WALL-MOUNTED EXPANDABLE TOILET TISSUE ROLL STORAGE MEANS

(71) Applicant: Yoga Thati, Brentwood, TN (US)

(72) Inventor: Yoga Thati, Brentwood, TN (US)

( * ) Notice: Subject to any disclaimer, the term of this patent is extended or adjusted under 35 U.S.C. 154(b) by 84 days.

(21) Appl. No.: 13/847,599

(22) Filed: Mar. 20, 2013

(65) Prior Publication Data

US 2013/0264411 A1 Oct. 10, 2013

Related U.S. Application Data

(60) Provisional application No. 61/620,050, filed on Apr. 4, 2012.

(51) Int. Cl.
*A47K 10/38* (2006.01)
*A47K 10/22* (2006.01)

(52) U.S. Cl.
CPC ..... *A47K 10/38* (2013.01); *A47K 10/22* (2013.01)

(58) Field of Classification Search
CPC ..... A47K 10/38; A47K 10/22; A47K 10/18; B65D 21/086; B65D 21/08
USPC ..... 220/8, 720, 751; 206/394, 391, 409; 248/312.1, 312, 311.2; 242/594.3
See application file for complete search history.

(56) References Cited

U.S. PATENT DOCUMENTS 3,007,177 A * 11/1961 Jackson et al. ..... 4/300.1
3,316,040 A * 4/1967 McGann ..... 312/45
4,294,389 A * 10/1981 Falk et al. ..... 225/34
4,607,809 A * 8/1986 Sineni et al. ..... 242/560
4,624,382 A * 11/1986 Tontarelli ..... 220/8
5,104,001 A * 4/1992 Negron ..... 221/276
5,467,733 A * 11/1995 Messina ..... 119/464
5,857,621 A * 1/1999 Poulos ..... 239/52
D407,588 S * 4/1999 Padilla ..... D6/520
D419,012 S * 1/2000 Wiggins, Jr. ..... D6/520
6,843,369 B2 * 1/2005 Daniels et al. ..... 206/225
6,968,970 B1 * 11/2005 Shacklee ..... 220/565
D547,984 S * 8/2007 Wolfson ..... D6/520
7,374,128 B2 5/2008 Hendrix et al.
7,588,209 B2 9/2009 Demers
2002/0096518 A1 * 7/2002 Foster, Sr. ..... 220/8
2004/0188297 A1 * 9/2004 Daniels et al. ..... 206/394
2004/0211693 A1 * 10/2004 Dotson ..... 206/391
2005/0126942 A1 6/2005 McAndrew
2006/0180698 A1 8/2006 Hensley
2008/0000902 A1 * 1/2008 Holbrook et al. ..... 220/8
2009/0250419 A1 10/2009 Szegfi (Continued)

*Primary Examiner* — Steven A. Reynolds
(74) *Attorney, Agent, or Firm* — Daniel Boudwin; Global Intellectual Property Agency LLC

(57) ABSTRACT

A toilet tissue roll holder is provided having a telescoping structure that is attachable to a wall surface for providing replacement toilet tissue to a dispenser and shrouding unused rolls prior to deployment. The device includes a lowermost housing having a base surface, rounded sidewalls, an interior volume, and an open front. The lowermost housing connects to a first upstanding sidewall thereabove, which in turn supports a plurality of telescoping sidewalls that form individual toilet tissue roll containers extending upward. A viewing window is provided through at least one of the device sidewalls above the lowermost housing to allow an administrator to visualize whether a minimum number of reserve toilet paper rolls are still available. The structure is expanded and contracted depending on the number of rolls therein, while the lowermost housing and first upstanding sidewall provide the base structure that is secured to a support wall.

4 Claims, 5 Drawing Sheets

(56) References Cited

U.S. PATENT DOCUMENTS

2011/0215187 A1 9/2011 Owurowa
2012/0145709 A1* 6/2012 Foster, Sr. ..... 220/8
2012/0248106 A1* 10/2012 Marta ..... 220/8

* cited by examiner

WALL-MOUNTED EXPANDABLE TOILET TISSUE ROLL STORAGE MEANS

CROSS REFERENCE TO RELATED APPLICATION

This application claims the benefit of U.S. Provisional Application No. 61/620,050 filed on Apr. 4, 2012, entitled "Extendable Bath Tissue Holder." The above identified patent application is herein incorporated by reference in its entirety to provide continuity of disclosure.

BACKGROUND OF THE INVENTION

1. Field of the Invention

The present invention relates to article holders and supports. More specifically, the present invention pertains to a toilet paper roll storage compartment that includes a telescoping structure and one that allows for ready replenishment of a consumed roll for the user.

Toilet tissue paper is a consumable product that is dispensed on a regular basis for sanitary purposes. Toilet tissue is dispensed in roll form, wherein the roll is eventually exhausted and in need of a replacement roll. The act of replacing exhausted rolls with fresh quantities is a common chore in both the commercial and residential settings, and involves locating a replacement toilet tissue roll, removing and discarding the exhausted roll, and placing the replacement roll onto the dispenser. It is common for this activity to happen often in frequently used rest areas and in homes with larger families, as a quantity of the consumable product is used by each successive person for personal hygiene. The ability to locate replacement rolls is imperative during this process to prevent the unwanted situation of being left with no available replacement. The inability to find a replacement roll can be inconvenient and embarrassing to the user.

Toilet paper rolls are generally stored within a cabinet or storage bin for ready access and deployment. In the home, the rolls are usually stored within their packaging and in some proximity to the toilet to enable replenishment of an extinguished roll when required. In a commercial setting, it is common for the toilet paper rolls to be deployed in larger quantities and for the purveyors of the business to have the restroom serviced with replacement quantities of toilet paper on a regular basis. However, quite often one can find themselves without a ready replacement and few alternatives. Without a ready quantity of replacements stored in proximity to the toilet, one can be stranded without access to replacement rolls.

For those restrooms that accommodate this scenario and include quantities of replacement toilet rolls in proximity to the toilet, it is imperative to provide also a barrier or shroud around the rolls to prevent contamination or moisture contact with the unused rolls. A shroud prevents the unused rolls from becoming damaged or unfit for use prior to their deployment, while a shroud also eliminate the unsightly and obvious placement of excess toilet tissue loosely placed within the toilet area. To both improve aesthetics and to prevent wasted toilet tissue paper, a device is required that offers toilet roll storage in proximity to the toilet area, while also offering a clean and controlled means of supporting replacement tissue paper prior to their deployment on the tissue paper dispenser.

The present invention provides a tissue paper roll storage means that offers an expanding structure having suitable storage area and a design that suitable for use in both residential and commercial settings. The device comprises a wall-mounted, telescoping structure having an internal volume for supporting stacked replacement toilet tissue rolls. The structure provides a subtle yet very useful means of storing replacement tissue rolls, where the device is preferably deployed in proximity of a toilet such that a replacement roll can be accessed and replaced on the dispenser as necessary by a user. The design shrouds the replacement rolls from moisture, while reducing the need for regular servicing of the bathroom in terms of tissue paper quantities.

2. Description of the Prior Art

Devices have been disclosed in the prior art that relate to toilet paper roll holders and dispensers. These include devices that have been patented and published in patent application publications, and generally relate to combination dispensers and storage means, or those that have diverging intent or structures as related to the present invention. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,588,209 to Demers discloses a toilet tissue holder dispenser that supporting a plurality of toilet rolls within and upstanding structure and allowing communicating of subsequent rolls from stowed position to a ready position by translating their roll supports along a guide rail or slot in the structure. The guide rail secures the toilet paper roll supports therealong, whereby a plurality of rolls having roll supports are stacked, and an uppermost roll is slid along the guide rail into a working position, and thereafter slid along the guide rail to a second rail branch to stow the used toilet paper roll prior to replacement with a fresh roll. The Demers device describes a unique and useful toilet paper roll support, but provides a more elaborate structure and one that is suited to both store toilet paper rolls and deploy them for use. The present invention contemplates only storage of toilet paper for extraction for later use.

U.S. Patent Application Publication No. 2006/0180698 to Hensley discloses a toilet paper storage member comprising a sleeve portion for supporting a plurality of stowed toilet paper rolls, while an upper assembly supports a toilet paper roll for dispensing purposes. The upper assembly attaches to an insert that feeds into the sleeve portion and allows withdraw of the stowed toilet paper rolls for replacement of the used roll along the upper assembly. While disclosing a combination dispensing and storing device, the Hensley device fails to disclose the novel aspects of the present invention, notably its telescoping structure for storing spare toilet paper rolls prior to deployment.

Similar to the Hensley device, U.S. Patent Application Publication No. 2011/0215187 to Owurowa discloses a toilet paper holder and dispenser, comprising a tower-like holder that stores a plurality of toilet paper rolls in a stacked configuration below a toilet paper roll head piece thereabove. The head piece comprises a dispenser that supports the toilet paper roll for allowing a user to withdraw toilet paper sheets from the supported roll, whereafter the stowed rolls can be moved into a working position when the head piece roll is exhausted. The head piece includes a flexible outer supports for the dispensed toilet paper roll rather than a through-rod. While disclosing a toilet paper storage device, the Owurowa device fails to disclose the structure of the present invention, which is directed to a telescoping structure apart from a bathroom toilet paper dispenser.

U.S. Patent Application Publication No. 2005/0126942 to McAndrew discloses a toilet paper storing sleeve having an elongated and tubular construction, a removable lid, and an internal pocket to store scented material for covering odor.

Similar to the aforementioned prior art devices, the McAndrew device fails to disclose the structural features of the present invention that allow it to store a quantity of toilet paper rolls for later deployment on a dispenser. The present invention provides a collapsible structure that expands to accommodate different quantities of toilet rolls, wherein an administrator can visually see the number of remaining rolls within the device.

The present invention provides a clean and readily deployable structure for storing unused and replacement toilet tissue rolls for an attendant or user to deploy onto a toilet paper dispenser within a restroom. The device is expandable to store several rolls, while its structure is suitable for both commercial and residential use, avoiding the problems associated with dispensing the last tissue paper square without a ready replacement on hand. It is submitted that the present invention is substantially diverges in design elements from the prior art, and consequently it is clear that there is a need in the art for an improvement to existing toilet tissue roll storage devices. In this regard the instant invention substantially fulfills these needs.

SUMMARY OF THE INVENTION

In view of the foregoing disadvantages inherent in the known types of toilet tissue roll storage devices now present in the prior art, the present invention provides a new storage device that includes a telescoping structure, wherein the same can be utilized for providing convenience for the user when storing replacement toilet tissue rolls in proximity to a dispenser for replenishing a quantity of used tissue paper when required.

It is therefore an object of the present invention to provide a new and improved toilet tissue roll storage device that has all of the advantages of the prior art and none of the disadvantages.

It is another object of the present invention to provide a toilet tissue roll storage device that is suited for residential and commercial use, and one that provides storage for a plurality of replacement rolls in proximity to a dispenser.

Another object of the present invention is to provide a toilet tissue roll storage device that can store several tissue paper rolls within its interior, whereby an administrator can visualize the number of replacement rolls still available between replenishing the rolls therein.

Yet another object of the present invention is to provide a toilet tissue roll storage device that shrouds the stored rolls from the environment, protecting the replacement rolls prior to deployment.

A final object of the present invention is to provide a toilet tissue roll storage device that includes a telescoping structure and a means for attaching to a wall surface.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
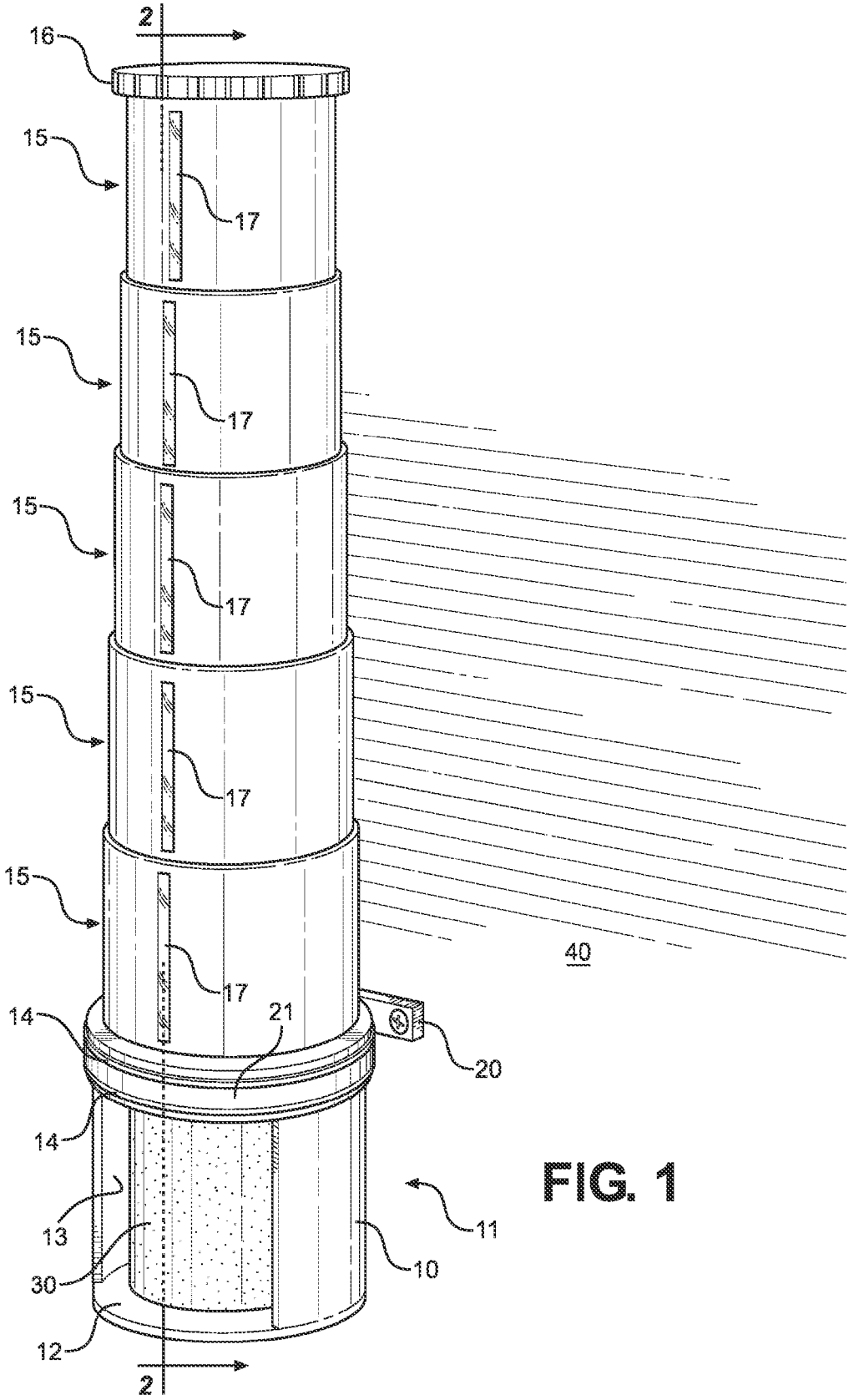
FIG. 1 shows a perspective view of the present invention in a working state, supported by a restroom wall and storing several replacement tissue paper rolls therein.

Reference is made herein to the attached drawings. Like reference numerals are used throughout the drawings to depict like or similar elements of the toilet tissue roll storage device. For the purposes of presenting a brief and clear description of the present invention, the preferred embodiment will be discussed as used for storing replacement quantities of toilet tissue paper within a restroom environment. The figures are intended for representative purposes only and should not be considered to be limiting in any respect.

Referring now to FIG. 1, there is shown a perspective view of the toilet tissue roll storage device of the present invention in a working state, supporting a plurality of replacement toilet tissue rolls 30 within its expanding interior for deployment by a user onto a dispenser. The device is a wall 40 mounted assembly having a telescoping and expanding structure, whereby the interior volume of the device provides sufficient volume within which to stack a plurality of vertically aligned tissue paper rolls 30, whereby the lowermost roll 30 is accessible by the user and thereafter the vertical stack of rolls 30 shortens. The top surface 16 of the device extends upward above the uppermost roll in the stack, thereafter falling to a different level as subsequent rolls are removed from the lowermost portion of the device. In this way, the present invention provides storage for a stack of replacement toilet tissue rolls that are shrouded from view and accessible one-by-one for deployment.

The assembly comprises a lowermost housing 11 having a rounded structure, upstanding sidewalls 10, a base surface 12, an open front, and an uppermost region for securing the device to an adjoining wall 40 by way of a wall attachment means. The wall attachment means preferably comprises an elongated clamping member 21 surrounding the lowermost housing 11 along its upper portion. The base 12 and sidewalls 10 form a partially open enclosure having an internal volume suitable for placement of a tissue paper roll 30 therein. A portion of the sidewalls 10 is left open 13 for the user to have ready access to the housing interior for grasping and retrieving a replacement roll 30 from therein. This opening 13 is adapted to be placed facing outward from the support wall 40, while the connection 20 between the clamping member 21 is facing the wall 40 and is secured thereto.

Along the upper portion of the lowermost housing 11 is a perimeter clamping member 21 that secures between two upstanding ridges 14 that form a circumferential channel 29 about the housing 11 upper. The clamping member preferably comprises an elongated band that secures within the channel and is fastened to the wall 40 by way of a fastener connection through the clamping member wall tabs 20, whereby the tabs are a flange or similar structural member extends from the clamping member 21 to lie flush with the wall 40. A hose clamp or similar structure may be suitable for supporting the assembly in this position, whereby the assembly and its contents are supported at this singular location to allow for the telescoping members 15, 18 above the lowermost housing to be free to collapse toward the lowermost housing 11 or remain in an extended position by way of an internal locking means that maintains the extended position of each telescoping member relative to the member below.

Above the lowermost housing 11 is a first telescoping member 18, which includes an upstanding and rounded sidewall that is adapted to accept the sidewalls of those telescoping members 15 thereabove into the interior of this first member 18. Each of the telescoping members 15, 18 includes a transparent viewing window 17, which is aligned with the lowermost housing opening 13 to allow a user or administrator to view through the assembly sidewalls to see how many replacement rolls are stored within the assembly. This provides notice to maintenance personnel as to whether replacement rolls need to be added within the assembly, or if the assembly is completed full thereof. Each of the telescoping members 15, 18 accepts a toilet tissue roll thereinto, whereby the member is lifted upwards from within its next closest member in a telescoping manner. Alternatively, the telescoping members can be withdrawn from one another in an extended position and locked into place by a user. Therefore, the overall height of the assembly is dictated by either the number of stored toilet tissue rolls within the assembly or the overall number of telescoping members 15 locked into an extended position. From the exterior, one can see the number of stored rolls by peering through the viewing window of each extended member. When the assembly is condensed, only the lowermost housing 11 and the first telescoping member 18 are visualized. Therefore, the viewing windows align to show an administrator if there are a minimum of two rolls therein within looking into the opening 13 of the lowermost housing 11.

Figure 2:
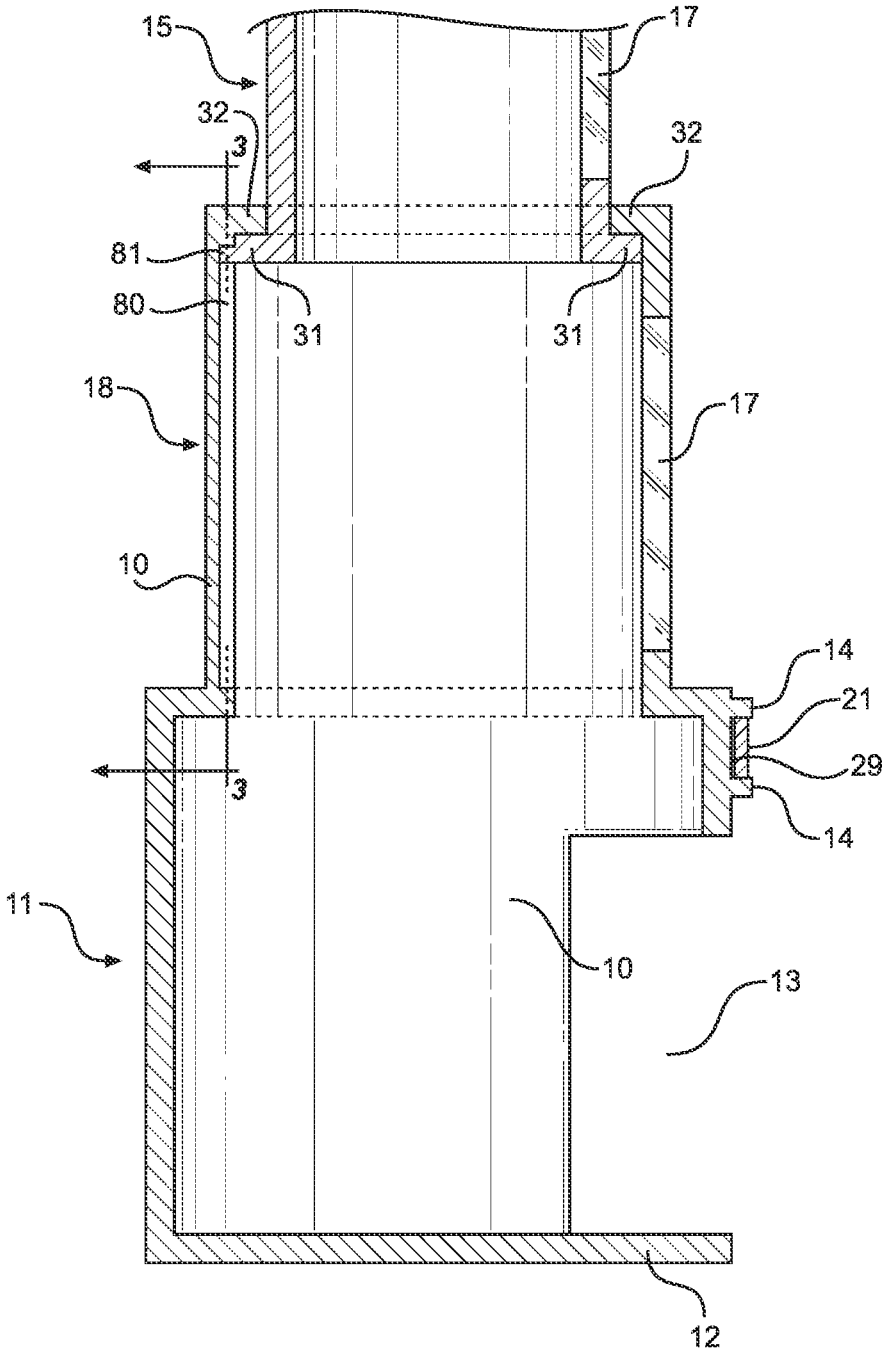
FIG. 2 shows a cross section view of the present invention in a deployed state.

Referring now to FIG. 2, there is shown a cross section view of the present invention, wherein a cut plane is provided through the lowermost housing 11, the first telescoping member 18, and one additional telescoping member 15 thereabove. The lowermost housing 11 comprises a frontal opening 13 for access to the housing 11 interior volume, along with a base surface 12 that provides support for the vertically stacked toilet tissue rolls within the interior of the lowermost housing 11 and telescoping members 18, 15 thereabove. Along the upper portion 32 of the housing 11 is a channel 29 supporting a clamping member 21 between two upstanding ridges 14. The channel 29 extends coextensively about the perimeter of the rounded housing exterior, and can terminate along a portion along the backside of the housing (opposite of the opening 13, as shown), or the channel 29 can span the circumference of the housing. This arrangement is but one contemplated embodiment of the connection between the lowermost housing and an adjacent wall. Alternate embodiments contemplate flanges extending from the backside of the lowermost housing for connection to a wall surface, or even a flat rear surface of the housing 11 opposite of its opening 13, whereby fasteners can be driven therethrough. These are but alternatives to the preferred configuration, which is that disclosed in FIG. 3.

In a preferred embodiment, the lowermost housing 11 is secured to the first telescoping member 18, whereby this structure forms the basis arrangement of the device that does not collapse any further. Subsequent telescoping members 15 above the first member 18 collapse into and expand from the first member 18 to account for the stack of toilet tissue rolls therein. Each of the telescoping members 15 include a side wall and a lower ledge 31 that catches an inward ledge 32 along the upper portion of another telescoping member. In this way, one member 15 can be drawn from another member to a given telescoping distance, up to the point where the ledges 31, 32 contact each other. In this way, the telescoping members do not separate from one another when expanded upwards.

The interior volume of the uppermost telescoping member must be sufficient to store a replacement toilet tissue roll therein with adequate interior clearance. The lower telescoping members include an interior volume that is suited for accepting a toilet tissue roll therein, along with the sidewalls of an above telescoping member that is collapsed thereinto. In this way, the rolls can be stored within the interior of the assembly in a stacked configuration with adequate clearance, and the telescoping members can be collapsed from one another as required without interferences or blockages. When collapsed or expanded, the viewing window 17 along the forward portion of the assembly and above the lowermost opening 13 provides a means to view the replacement tissue paper within the interior of the assembly.

Figure 3:
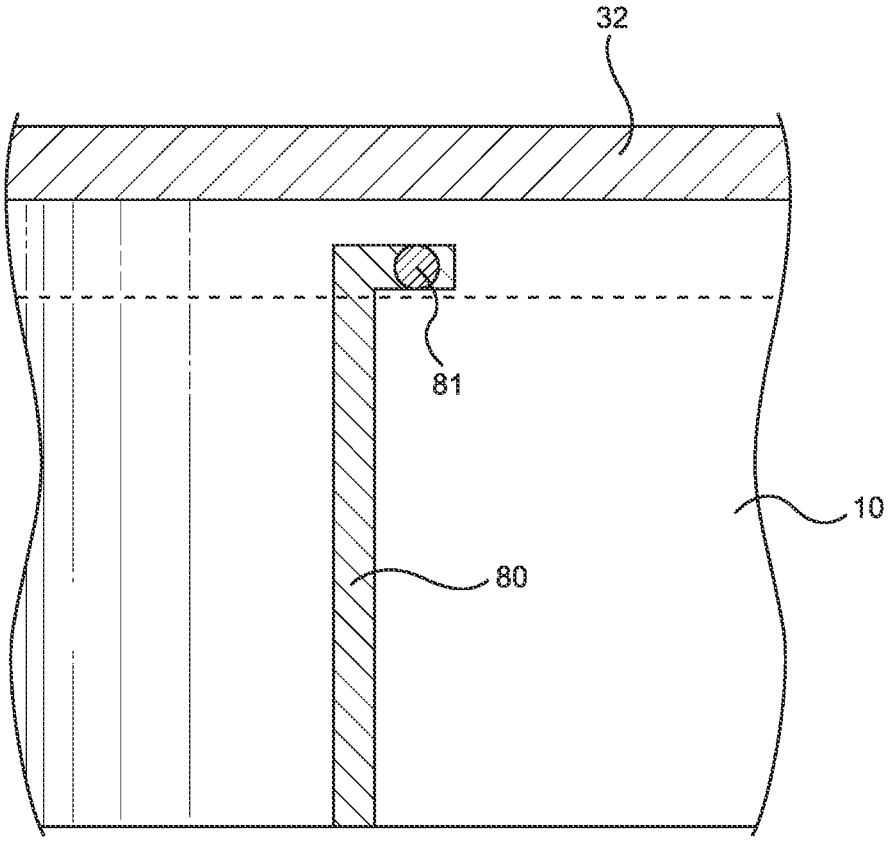
FIG. 3 shows a cross section of the locking mechanism between telescoping members that prevents the same from collapsing into underlying members.

Referring to FIGS. 2 and 3, there is shown the telescoping member locking means. Along the inner wall of the first telescoping member 18 and subsequent telescoping members 15 thereabove, an elongated, L-shaped channel 80 is disposed for providing a means of locking each member into an extended position relative to a member therebelow. The channel 80 extends vertically and accepts a tab 81 from an above telescoping member, whereby the tab 81 slides within the vertical portion of the channel 80 until it reaches its uppermost extent. This uppermost extent is equal to the uppermost position the telescoping member may travel relative to a member therebelow, whereby the ledges 32, 31 are abutted against one another. When the tab 81 reaches this uppermost extent, the tab 81 is exposed to the horizontal portion of the channel 81. The user can rotate the member such that the tab 81 is inserted into the channel horizontal portion. Whereafter, the channel 80 supports the tab 81 and prevents the telescoping member from collapsing into the member therebelow. In this way, a user can extend and lock the telescoping members in to an extended position, regardless of the number of toilet tissue rolls positioned therein.

Figure 4:
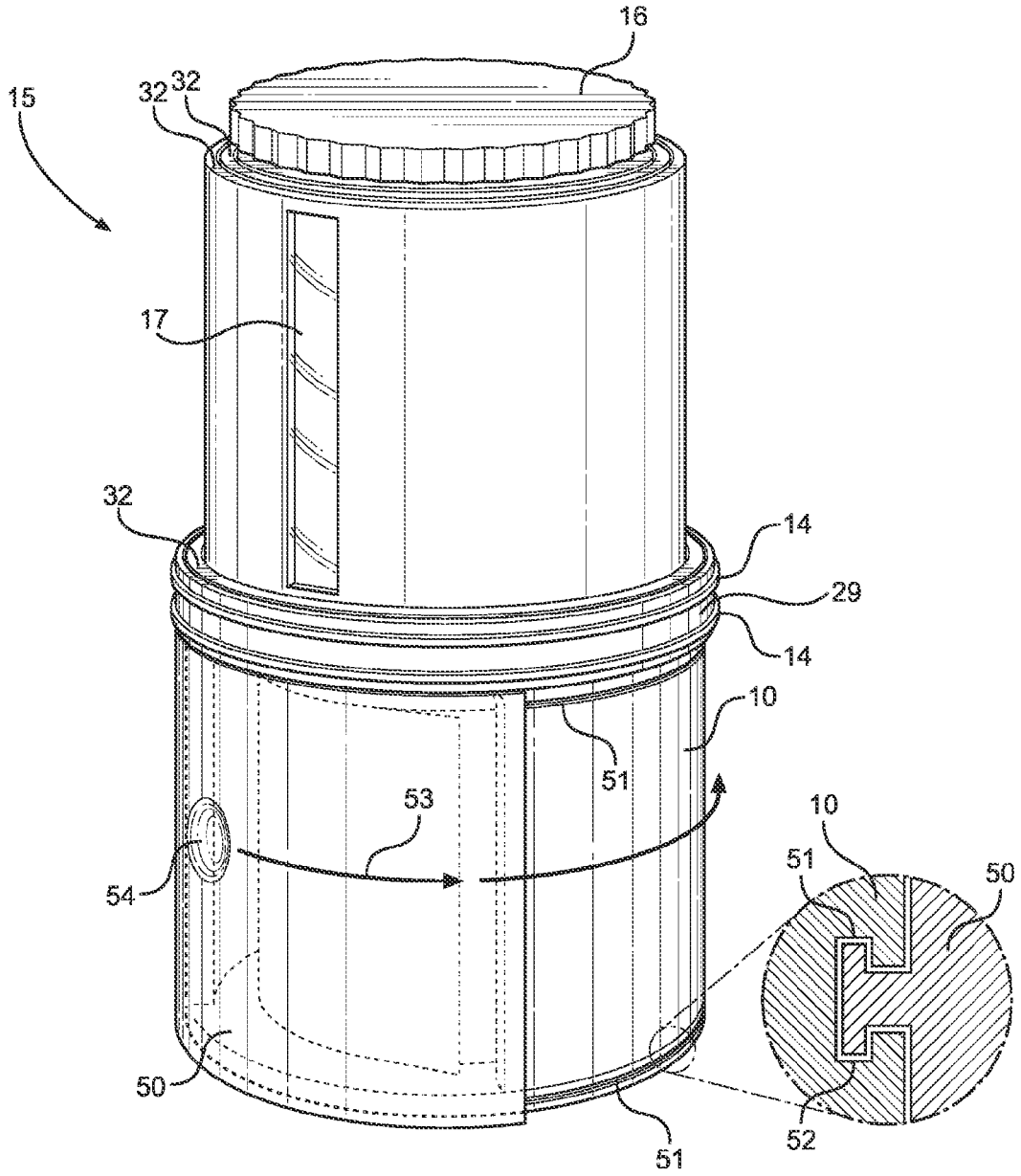
FIG. 4 shows a view of the preferred embodiment of the present invention in its most collapsed state.
Figure 5:
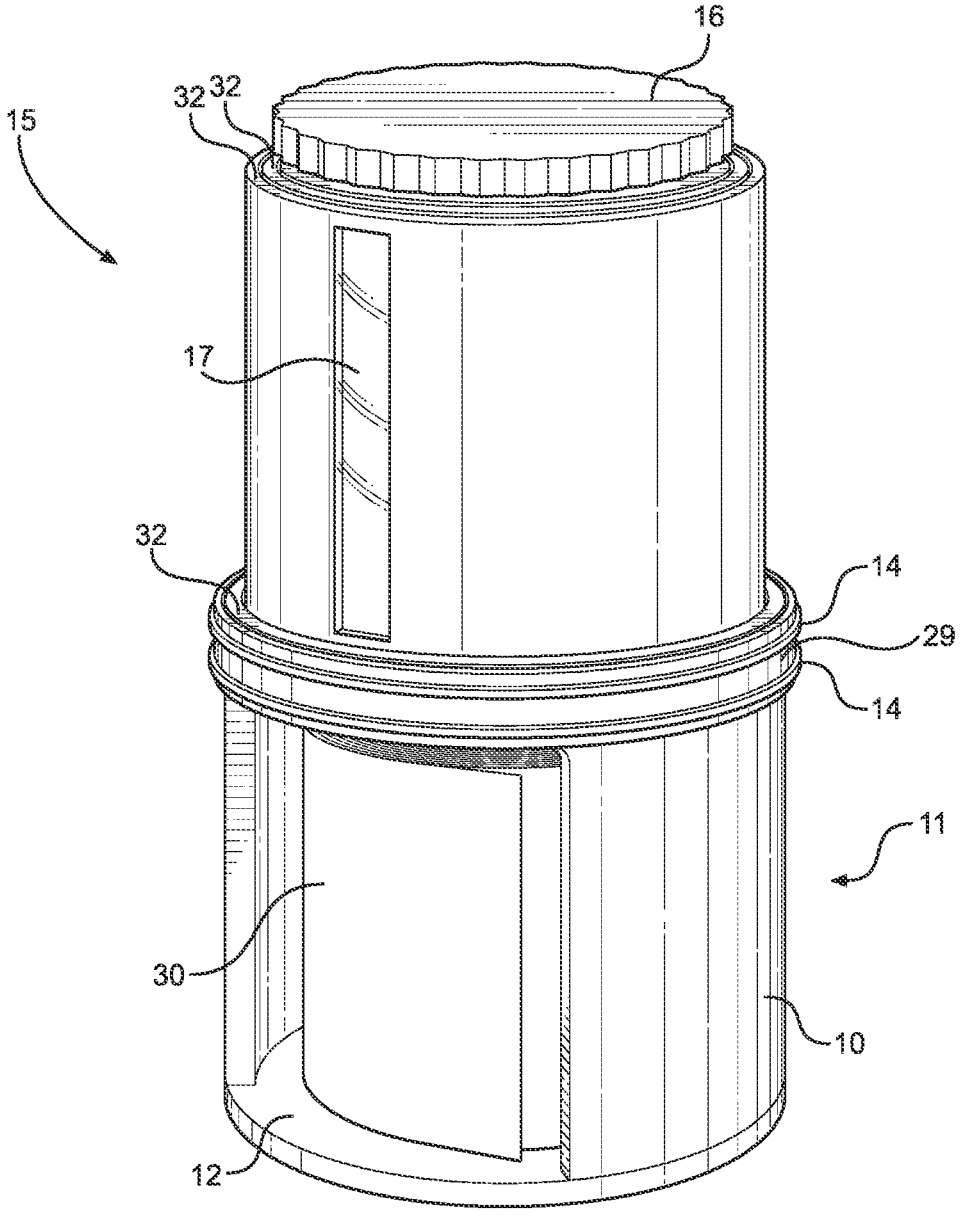
FIG. 5 shows a perspective view of an embodiment of the present invention, whereby the lowermost housing includes a door member for sealing the interior of the device.

Referring now to FIGS. 4 and 5, there are shown perspective views of the toilet roll storage device in its most condensed form. The device, while condensed, includes the lowermost housing 11 and the first telescoping member 18, which stores subsequent telescoping members within its interior. The viewing windows 17 of the condensed members provide an administrator or user to visualize the interior of the assembly to see if there are at least two rolls in the assembly, without requiring the user to peer into the opening of the lowermost housing 11. As shown, the telescoping members are collapsed, whereby their sidewall ledges 32 are aligned concentrically within the first telescoping member 18, while the top surface 16 of the uppermost telescoping member is readily graspable for a user to expand the structure upwards. This is important when loading the assembly with replenishment toilet tissue rolls 30. The user grasps this surface 16 and lifts the assembly upwards, or alternatively the lowermost roll 30 is forced upward to lift this surface 16 and make room within the lowermost housing 11 for a replacement roll. While replacing the rolls, the structure is supported against a wall surface by way of the clamping element within the lowermost housing channel 29, and between the channel upstanding ridges 14 that confine the clamping element within the channel interior.

Referring now to FIG. 4, there is shown an embodiment of the present invention that contemplates a slideable or otherwise removable door 50 that covers the lowermost housing opening. When deployed in a restroom environment, airborne contaminants, moisture, and contact with foreign bodies can cause damage and compromise the replacement tissue rolls within the assembly. To prevent the replacement rolls from becoming compromised while being stored and to maintain their sterility prior to deployment, a door 50 is contemplated over the lowermost opening. The exact design of the door 50 can take several forms, including the sliding door 50 as shown in FIG. 3, a hinged door, a replaceable door, or any suitable structure that covers the opening and provides a relatively continuous lowermost sidewall structure is desired.

In a preferred embodiment, a sliding door 50 is provided over the opening, which slides 53 about the outer perimeter of the lowermost housing 11 when opening and closing over the opening thereinto. The door 50 slides within a first and second sliding door channel 51 running along the sidewall 10 of the housing 11, wherein a door tab 52 is secured within the channel that allows the door to slide 53 about the housing 11. To facilitate the sliding motion 53, a finger hole 54 or door handle is provided, whereby the user can obtain purchase over the door and forcibly move it along the channel. Use of the door 50 is designed to shroud the interior contents of the assembly, whereby airborne contaminants and moisture is prevented from direct contact with the toilet tissue therein. The sliding door 50 comprises an outer surface, an inner surface, and a shape capable of sliding and conforming to the lowermost housing sidewalls. The door inner surface includes the sliding door tabs 52, which are received within the sliding door channels to allow the sliding door to be slideable along the channels over the lowermost housing opening. When over the lowermost housing opening, the door is in a closed position, and when slide away from the opening along said lowermost housing sidewall, the door is in an open position.

An alternate embodiment of the door shroud includes a hinged door, wherein the door comprises an edge that is pivotably connected to the lowermost housing sidewall by way of a hinge joint. The hinge joint allows the door to be pivoted over the lowermost opening and pivoted therefrom, alternating between a closed and position, respectively.

It is typical for both homeowners and commercial establishments to keep multiple rolls of toilet paper available in the bathroom, whereby a dispenser can readily be replenished to avoid any shortages during bathroom use. However, many bathrooms lack storage space, and there may not be enough room to store multiple rolls of toilet paper. One may become frustrated when the toilet paper runs out and there is no spare roll, and it can be embarrassing to have to call for someone for assistance, as typically the absence of toilet tissue is not realized until absolutely necessary. In establishments where replacement rolls are available, it is not uncommon for the replacement rolls to become damaged or unusable after contact with the environment, contamination, or contact with moisture in the restroom area.

The present invention relates to a toilet tissue roll storage device and replacement roll holder. The device is an expandable assembly that enables a user or administrator to store replacement rolls of tissue paper within the bathroom environment and in close proximity to a dispenser, whereby a user can obtain a replacement roll when necessary without assistance. It is desired that a plurality of rolls can be stored vertically in the disclosed expandable assembly, while its attachment to a support wall and an optional door over its opening may take on several different designs, falling within the spirit of the invention. The present invention saves space and provides a way for homeowners to keep extra toilet paper rolls within arm's reach.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expandable toilet tissue roll storage device, comprising:

a lowermost housing having a base surface, upstanding sidewalls, an interior volume, and an opening through said sidewalls for accessing said interior volume;

a wall attachment means disposed on said lowermost housing and adapted for securement to a wall surface;

a first telescoping member above said lowermost housing, said first telescoping member having sidewalls forming an interior volume;

at least one extendable telescoping member extendable above said first telescoping member, said at least one extendable telescoping member having sidewalls that form an interior volume, and wherein said at least one extendable telescoping member is sized to fit within said first telescoping member;

an upper surface on an uppermost telescoping member;

a transparent viewing window along said telescoping members for viewing each telescoping member interior volume;

a door shroud member over said lowermost housing opening for enclosing said interior volume thereof, wherein said door shroud member is adapted to rotate circumferentially around an exterior of said lowermost housing.

2. The device of claim 1, wherein said wall attachment means further comprises an elongated clamping member secured within a channel along an upper portion of said lowermost housing, said clamping member having tabs fastenable to a wall surface.

3. The device of claim 1, wherein said door shroud member comprises an outer surface, an inner surface, and a shape capable of rotating around said lowermost housing sidewalls;

said inner surface further comprising a first and second sliding door tab;

said lowermost housing further comprising a first and second elongated sliding door channel for receiving said first and second sliding door tabs, respectively;

wherein said first and second elongated sliding door channels extend around the circumference of said housing;

said door shroud member being slideable along said first and second sliding door channels over said lowermost housing opening into a closed position, and sliding along said lowermost housing sidewall into an open position.

4. The device of claim 1, wherein said first telescoping member and extendable telescoping members further comprise:

a locking means for securing said member in an extended position;

said locking means comprising an L-shaped channel for receiving a tab protruding from an extendable telescoping member, said channel having an elongated vertical portion and a horizontal portion at an uppermost extent thereof;

said extendable telescoping members capable of rotating such that said tab enters said channel horizontal portion.

* * * * *